United States Patent [19]

Ylonen

[11] 4,302,749

[45] Nov. 24, 1981

[54] AUTOMATIC FIRING FOR CLAY PIGEON LAUNCHER

[76] Inventor: Erkki Ylonen, Tutkamiehentie 9,, SF-41160 Tikkakoski, Finland

[21] Appl. No.: 52,573

[22] Filed: Jun. 27, 1979

[30] Foreign Application Priority Data

Jul. 3, 1978 [FI] Finland ..... 782129

[51] Int. Cl.[3] ..... G08B 5/22; F14C 19/12

[52] U.S. Cl. ..... 367/198; 124/34

[58] Field of Search ..... 340/148; 124/34; 179/1 UC; 307/154

[56] References Cited

U.S. PATENT DOCUMENTS

| | | | |
|---|---|---|---|
| 3,730,995 | 5/1973 | Mathews | 179/1 UC |
| 3,770,981 | 11/1973 | Nielsen | 124/34 |
| 3,893,081 | 7/1975 | Hopkins | 340/148 |

*Primary Examiner*—Harold I. Pitts

[57] ABSTRACT

A system for controlling operation of a clay pigeon launcher in response to a voice command, to one of a plurality of microphones. The system provides for the averaging of the signal output of the microphones and the selection of the output of highest level. These outputs are compared and if the highest level is greater than a predetermined magnitude provides an operating signal for the launcher.

5 Claims, 1 Drawing Figure

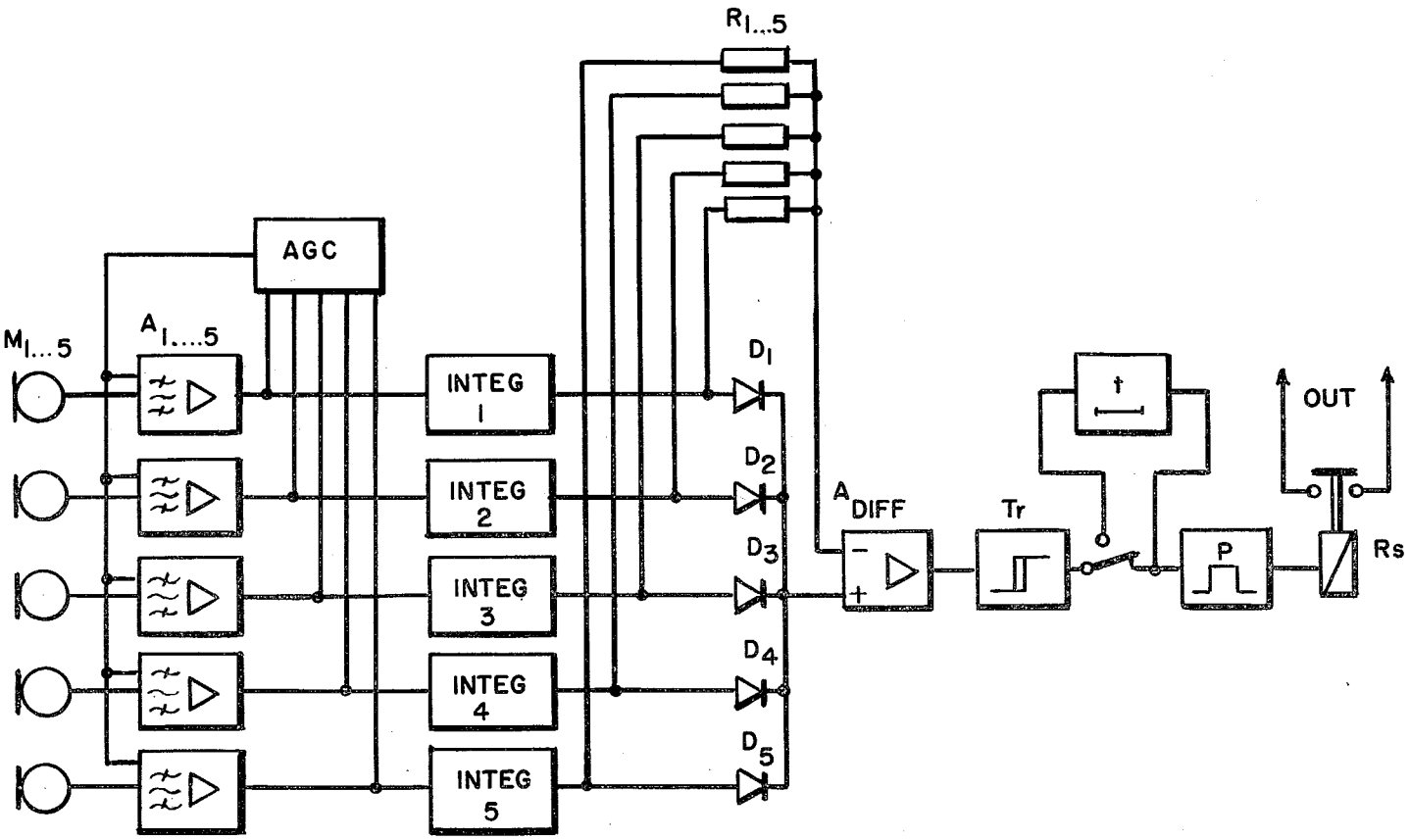
OUT
Rs
P
t
Tr
$A_{DIFF}$
$R_{1...5}$
$D_1$
$D_2$
$D_3$
$D_4$
$D_5$
INTEG 1
INTEG 2
INTEG 3
INTEG 4
INTEG 5
AGC
$A_{1...5}$
$M_{1...5}$

AUTOMATIC FIRING FOR CLAY PIGEON LAUNCHER

The present invention relates to a system for controlling the firing mechanism of the clay pigeon launcher which can be used in trapshooting and particularly to a voice actuated control system where firing is accomplished by a command given to a microphone.

Voice operated firing devices are already known. They have however not always been accepted for use in competitions. The reason for the ban is that spurious sounds have made the equipment unreliable.

The equipment consists normally of five microphones in parallel so that there can be a shooter at each microphone. In a known device (e.g. in the German Announcement Publication No. 1 172 158 and Application Publication No. 1 916 827) each microphone is connected separately to the equipment prior to shooting. This has however the drawback that a spurious sound reaching the microphone may fire the launcher. Besides, a person is usually required to service the equipment and to take care of the connecting, taking special care that only the given microphone for the single shooter on the line is connected. Practice has however proven that this described method is not operationally reliable especially due to spurious sounds. As is stated in the second cited German publication the disadvantage caused by interfering sounds is suggested to be removed by using an optical method to fire the device.

It is the object of the present invention to provide a system whereby the effect of spurious sounds reaching the microphone has been eliminated and by using novel circuitry all the microphones can be connected. Using the equipment of the present invention it is thus not necessary to have a person to take care of connecting the microphones.

SUMMARY OF THE INVENTION

According to the present invention the output of each of the microphones are simultaneously averaged to determine an average signal level, while they are compared to select the output of highest signal level. The highest signal level output is then compared with the average signal level and an operating signal produced if the highest signal output has a magnitude greater than a predetermined limit. This operating signal then energizes the launcher.

In carrying out the invention a plurality of microphones connected to associated filter-amplifiers, integrators and automatic gain control circuits produces individual outputs which are connected to a resistor, and to a diode. The common output of the resistors provide an average signal which the diodes compare and pass the highest signal. The common output of the resistors is fed to one input of a differential amplifier which the common output from the diode is fed to the other input of the differential amplifier. The output of the differential amplifier is fed to a trigger circuit, having a time delay and pulse generator for energizing the launcher.

BRIEF DESCRIPTION OF THE DRAWINGS

The invention is described in the block diagram of the enclosed FIGURE.

DESCRIPTION OF THE INVENTION

The diagram shows a system where there are five microphones $M_1$ to $M_5$ located at individual shooting sites. The signals from the microphones are amplified and filtered in circuits $A_1$ to $A_5$ from whose outputs the signals go to integrating circuits. $Integ_1$ to $Integ_5$, and to the automatic gain control circuit AGC whose output controls the amplification of circuits $A_1$ to $A_5$. The integrating circuits $Integ_1$ to $Integ_5$ generate DC voltages whose levels are proportional to the signal amplitudes and durations, from which an average is formed by resistors $R_1$ to $R_5$, which average is fed to the negative input of a differential amplifier $A_{diff}$. The largest DC voltage selected by diodes $D_1$ to $D_5$ is fed to the positive input. If any microphone receives a sound of a higher level than the others, the voltage of the positive input of the differential amplifier $A_{diff}$ becomes larger than the negative, and the output voltage of the differential amplifier increases and loads the trigger circuit (Tr). The trigger output controls either directly or through an 0.1 to 0.2 second delay (t) a pulse circuit P which controls a relay $R_s$. The contacts of relay $R_s$ close the firing circuit of the launcher and the device operates. The delay circuit t simulates the delay inherent in manual operation. Short duration sounds generated at the microphone, such as from cocking a gun, are filtered out in the integrating circuits.

As is seen from the above, spurious sounds do not cause triggering. All the microphones are always ready to fire. As spurious sounds do not cause firing, it has been possible to make the equipment much more sensitive than known equipment in use.

The equipment is realised using integrated amplifying and CMOS logic circuits. When microphones of the same type and components of the same manufacturing series are used in all channels, the channels are sufficiently indentical to make the operation reliable.

A solution to realise the method of the invention is given in the adjacent block diagram. The solution is naturally possible also in a different manner as long as one stays within the framework of the patent claim.

The equipment in the example shows five microphones in accordance with the five shooting positions in trapshooting. There can be more microphones as in skeet.

I claim:

1. A voice actuated system for electrically operating, in response to a command from one of a plurality of users, a clay pigeon launcher or the like, comprising means associated with each of a plurality of stations for converting sound into respective electric signal outputs, means for determining the average signal level of said outputs from all of said sound means, means for comparing the level of the signal outputs of each of said sound converting means and selecting the one having the highest level, means for comparing the output from the sound converting means having the highest signal level with the average signal level and passing an operating signal when the highest signal level is greater by a predetermined amount than said average signal, and means responsive to said operating signal for ergizing said launcher.

2. The system according to claim 1, wherein said means for energizing said launcher includes means for delaying the determined signal, a pulse generator, and relay means responsive to said pulse generator for activating said launcher.

3. The system according to claims 1 or 2, wherein each of said sound converting means comprises a microphone, circuit means for filtering and amplifying the output signal from said microphones, circuit means for integrating said filtered and amplified signal and an automatic gain control circuit responsive to the output of said circuit means for filtering and amplifying the output signal of said microphones, to control the respective circuits for filtering and amplifying the output of said microphones.

4. The system according to claim 3 including a resistor and a diode connected in parallel to the output of each of said integrators, and a differential amplifier having a pair of inputs and an output connected to said means for energizing said launcher, the outputs of said resistors being connected in common to one input of said differential amplifier and the outputs of said diodes being connected in common to the other input of said differential amplifier.

5. A method for controlling the actuation of a clay pigeon launcher or the like in response to a sound command to one of a plurality of microphones comprising the steps of averaging the signal output of said microphones, selecting the output of highest level, comparing the output of highest level with that of the average level, and in response to determining that the highest level ouput is greater by a predetermined magnitude than the average level produces an operating signal and passing said operating signal to said launcher.

* * * * *